US005433233A

United States Patent [19]

Shiran et al.

[11] Patent Number: 5,433,233

[45] Date of Patent: Jul. 18, 1995

[54] UMBRELLA

[75] Inventors: Shimon Shiran, Haifa; Yonathan Zabary, Tel Aviv, both of Israel

[73] Assignee: Sol Camping Industries Ltd., Barkan, Israel

[21] Appl. No.: 234,828

[22] Filed: Apr. 28, 1994

[30] Foreign Application Priority Data

Apr. 27, 1993 [IL] Israel ..... 105531

[51] Int. Cl.[6] ..... A45B 11/00

[52] U.S. Cl. ..... 135/20.1; 135/29; 135/32; 248/530; 403/11; 403/41; 403/161

[58] Field of Search ..... 135/19, 20.3, 20.1, 135/29, 30, 32, 33.4, 33.41; 248/530, 146, 311.2, 400; 403/11, 41, 343, 66, 161

[56] References Cited

U.S. PATENT DOCUMENTS

| | | | |
|---|---|---|---|
| 216,490 | 6/1879 | Walsh . | |
| 449,716 | 4/1891 | Thorp . | |
| 653,164 | 7/1900 | Bedel . | |
| 667,719 | 2/1901 | Moulton . | |
| 1,736,177 | 11/1929 | Snook . | |
| 1,783,972 | 12/1930 | Moses | 135/19.5 X |
| 1,924,426 | 8/1933 | Williams | 135/19.5 X |
| 2,474,516 | 6/1949 | Daniel | 135/20 |
| 2,561,435 | 7/1951 | Woodward | 135/20 |
| 2,607,362 | 8/1952 | Evans | 135/20 |
| 2,788,792 | 4/1957 | Koller | 135/20 |
| 3,156,249 | 11/1964 | Biderman | 135/20 |
| 3,177,883 | 4/1965 | Militano | 135/20 |
| 3,254,658 | 6/1966 | Kraft | 135/20 |
| 3,419,026 | 12/1968 | Evans | 135/20 |
| 3,419,295 | 12/1968 | Small | 135/20.3 X |
| 3,446,221 | 5/1969 | Truitt | 135/19.5 |
| 3,521,651 | 7/1970 | Pearlstine | 135/20.3 X |
| 3,564,679 | 2/1971 | Meyer | 29/25 |
| 4,347,862 | 9/1982 | Secon | 135/20 R |
| 4,368,749 | 1/1983 | Lindler | 135/20 R |
| 4,622,987 | 11/1986 | Redl et al. | 135/20.3 |
| 4,834,126 | 5/1989 | Sweet | 135/25 R |
| 4,877,045 | 10/1989 | Lin | 135/20.3 |
| 4,998,696 | 3/1991 | Desjardins | 248/146 |
| 5,046,699 | 9/1991 | Perreault et al. | 248/530 X |
| 5,085,239 | 2/1992 | Chin-Hung | 135/25.33 |
| 5,326,064 | 7/1994 | Sapien | 248/146 X |

*Primary Examiner*—Lanna Mai
*Attorney, Agent, or Firm*—Darby & Darby

[57] ABSTRACT

An umbrella including a central shaft, a plurality of fabric support ribs extending outwardly from the central shaft, a fabric cover associated with the fabric support ribs, a plurality of rib support elements for supporting the fabric support ribs and a plurality of detachable attachment elements, each operative to detachably attach a rib support element onto a fabric support rib, whereby in response to strong winds or other forces, detachment occurs, thereby preventing breakage of the support ribs.

3 Claims, 10 Drawing Sheets

UMBRELLA

FIELD OF THE INVENTION

The present invention relates to umbrellas generally.

BACKGROUND OF THE INVENTION

A great variety of umbrellas is represented in the patent literature including wind-resistant umbrellas and umbrellas formed of plastic materials. The following U.S. Pat. Nos. are believed to represent the prior art: 216,490; 449,716; 653,164; 667,719; 1,736,177; 2,474,516; 2,561,435; 2,607,362; 2,788,792; 3,156,249; 3,177,883; 3,252,468; 3,254,658; 3,419,026; 3,564,679; 4,347,862; 4,368,749; 4,834,126; 5,085,239.

SUMMARY OF THE INVENTION

The present invention seeks to provide an improved umbrella.

There is thus provided in accordance with a preferred embodiment of the present invention an umbrella including a central shaft, a plurality of fabric support ribs extending outwardly from the central shaft, a fabric cover associated with the fabric support ribs, a plurality of rib support elements for supporting the fabric support ribs and a plurality of detachable attachment elements, each operative to detachably attach a rib support element onto a fabric support rib, whereby in response to strong winds or other forces, detachment occurs, thereby preventing breakage of the support ribs.

The present invention provides easy of assembly during manufacture and repair.

There is additionally provided in accordance with a preferred embodiment of the present invention an umbrella base including a plurality of concentric recesses each of a different size for accommodating a variety of differently sized umbrella shafts.

There is further provided in accordance with a preferred embodiment of the present invention an umbrella including a central shaft having upper and lower portions, a fabric cover supported on the central shaft and a tiltable mounting assembly connecting the upper and lower portions of the central shaft, and wherein the upper shaft portion defines a first longitudinal axis and includes a recess opening at a bottom end thereof and defines a bottom end surface at the recess including a first surface portion extending perpendicular to the first longitudinal axis and a second surface portion angled with respect to the first surface portion, the lower shaft portion defines a second longitudinal axis, and wherein the tiltable mounting assembly includes a support element mounted on the lower shaft portion and defining a support surface extending perpendicular to the second longitudinal axis and having an upstanding portion extending into the recess on the upper portion, the upstanding portion including an angled bearing surface; and an anchor element mounted inside the recess of the supper shaft portion and pivotably mounted onto the upstanding element, the upper shaft member being tiltable with respect to the upstanding element such that the second surface portion rests on the support surface and the angled bearing surface lies against an inner side surface of the recess.

Various combinations of the foregoing features are also within the scope of the present invention.

BRIEF DESCRIPTION OF THE DRAWINGS

The present invention will be more fully understood and appreciated from the following detailed description, taken in conjunction with the drawings in which.

DETAILED DESCRIPTION OF A PREFERRED EMBODIMENT

Figure 1:
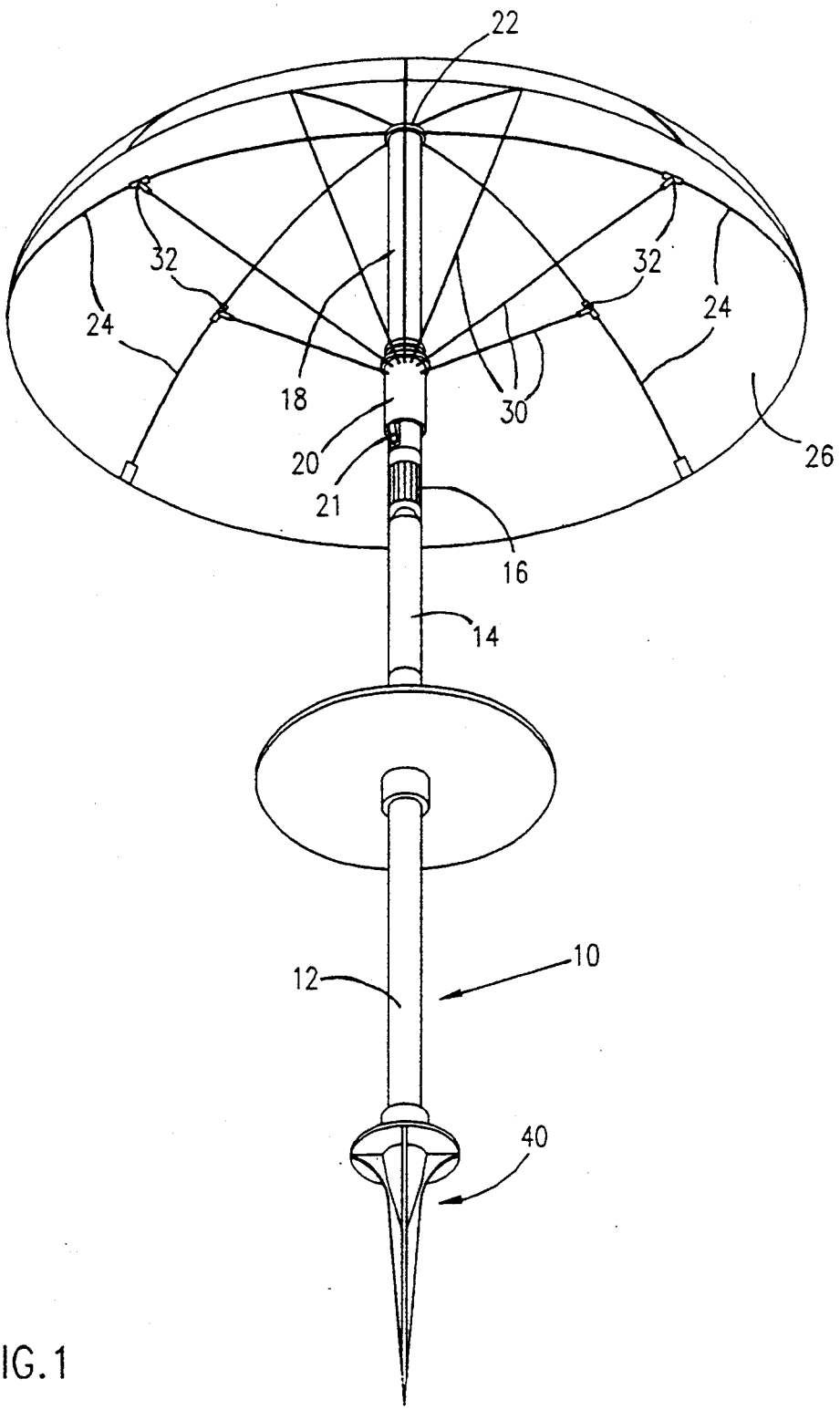
FIG. 1 is a simplified pictorial illustration of an umbrella constructed and operative in accordance with a preferred embodiment of the present invention.
Figure 2A:
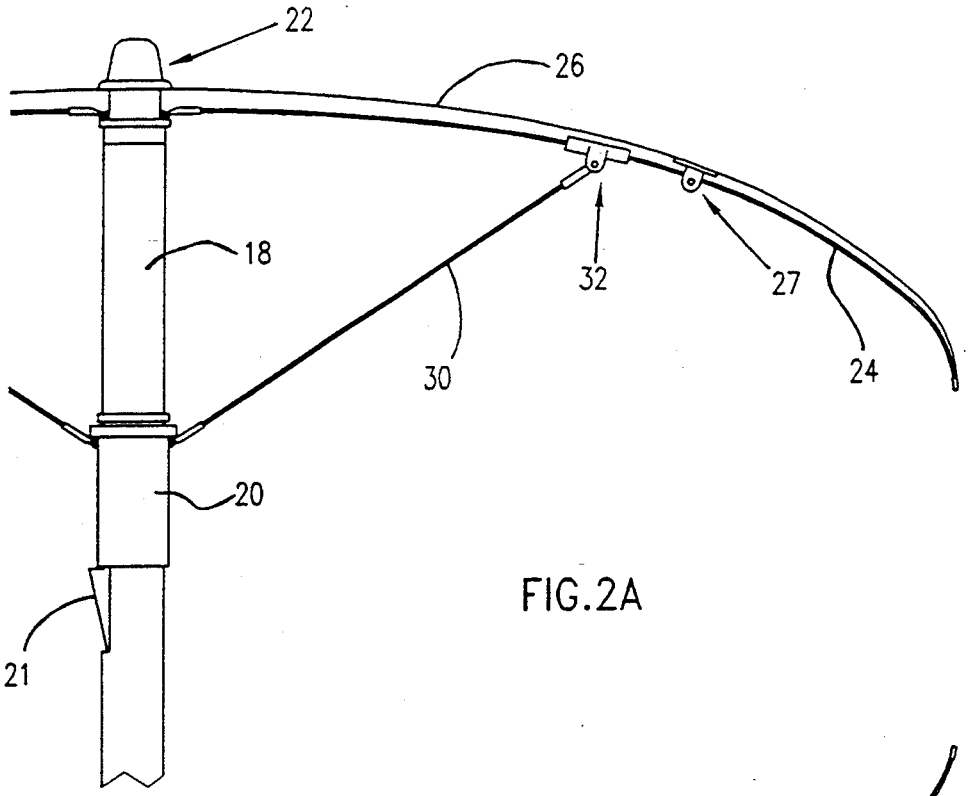
FIGS. 2A and 2B are illustrations of part of the apparatus of FIG. 1 in two operative orientations.
Figure 2B:
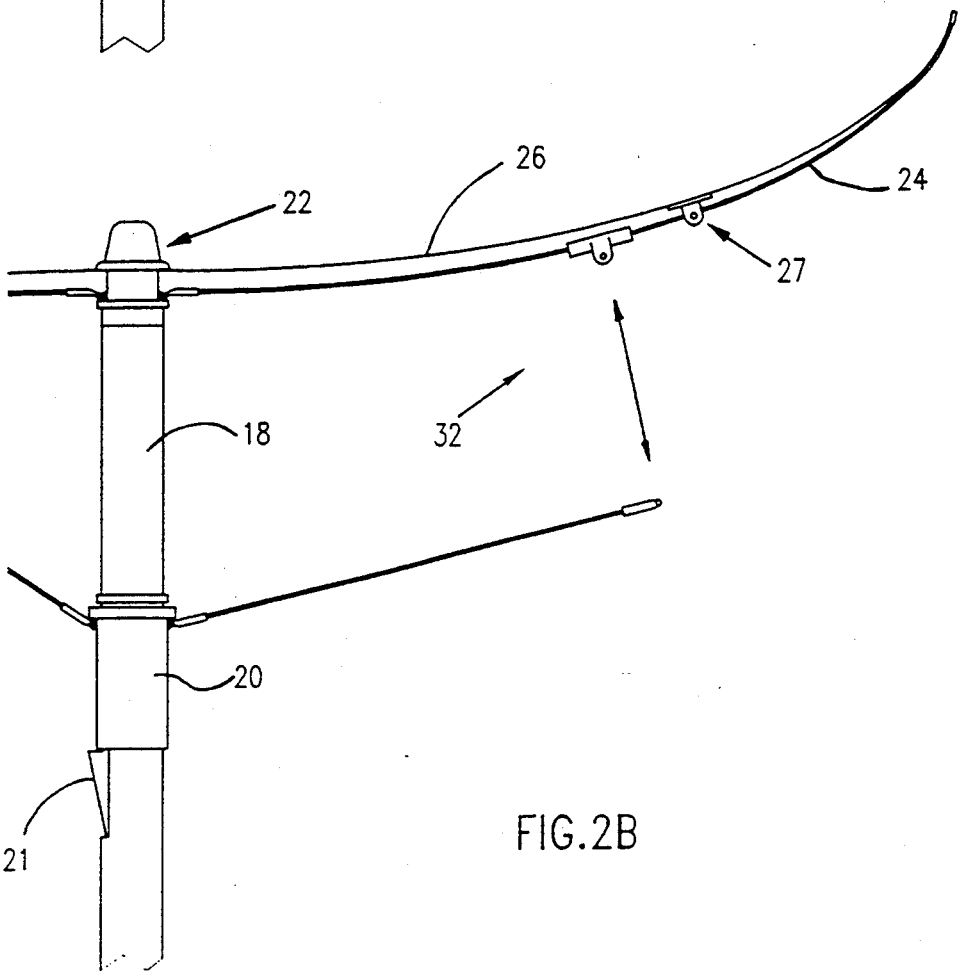

Reference is now made to FIGS. 1, 2A and 2B which illustrate an umbrella constructed and operative in accordance with a preferred embodiment of the present invention. It is to be appreciated that although the umbrella shown and described hereinabove is a stationary umbrella which is intended to be supported on a ground surface, the present invention also applies to any other suitable type of umbrella.

As shown in FIGS. 1, 2A and 2B, the umbrella includes a central shaft 10, typically comprising first and second separable shaft portions 12 and 14. Mounted onto shaft portion 14 there is preferably provided a tiltable mounting assembly 16, the structure and operation of which will be described hereinbelow in detail with reference to FIGS. 8A–10B.

Disposed above assembly 16 is a top shaft portion 18, with which is associated a slidable collar assembly 20, associated with a conventional ratchet lock assembly 21. Mounted on the top of top shaft portion 18 is a cap assembly 22, which is shown in greater detail in FIG. 4.

Figure 4:
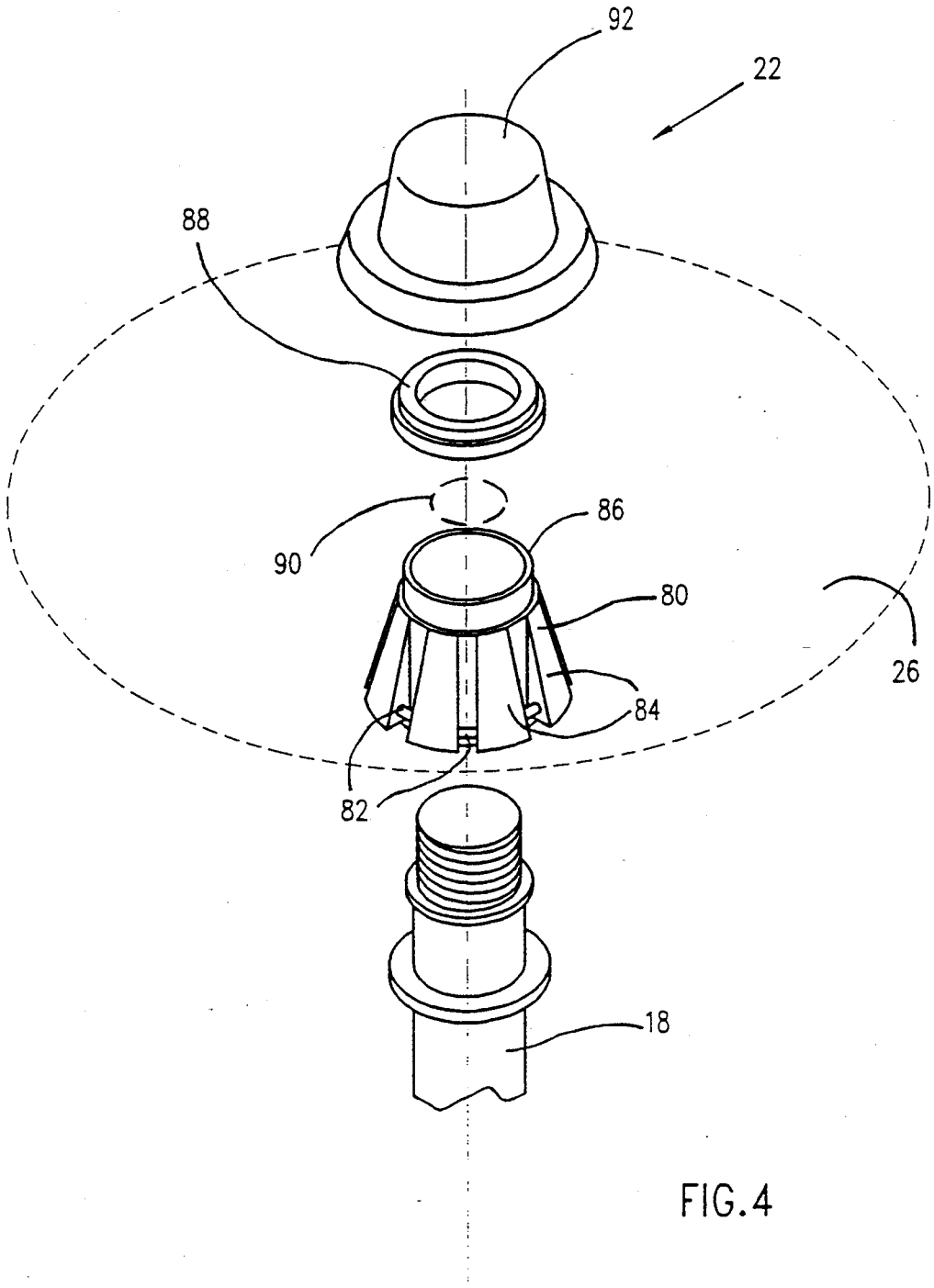
FIG. 4 is a simplified exploded view illustration of mounting apparatus forming part of the umbrella of FIG. 1.
Figure 5A:
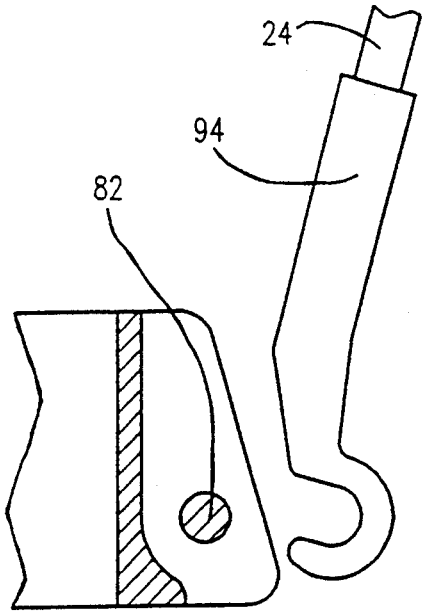
FIGS. 5A ,5B, 5C and 5D illustrate four stages of the mounting of fabric support ribs on part of the apparatus of FIG. 4.
Figure 5B:
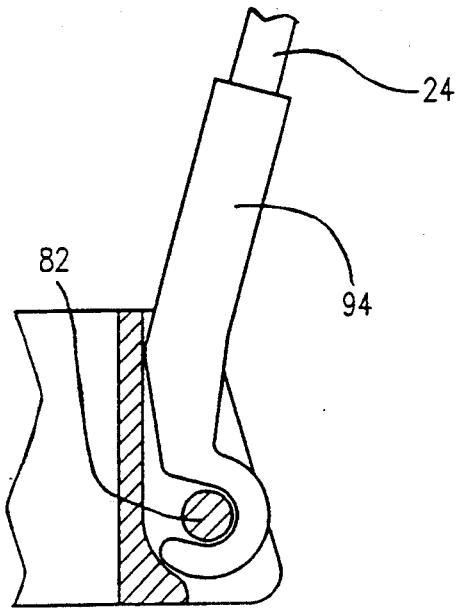
Figure 5C:
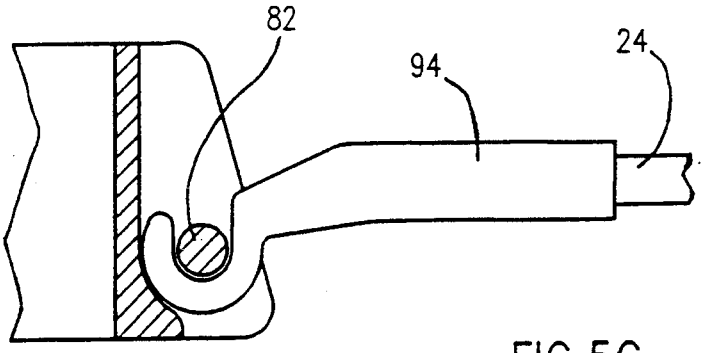
Figure 5D:
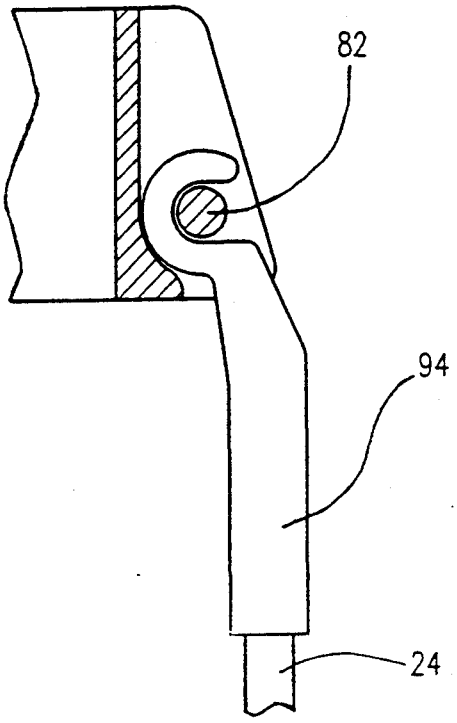

A plurality of fabric support ribs 24 are pivotably mounted onto cap assembly 22, as will be described hereinbelow with reference to FIGS. 4–5D and extend outwardly from the central shaft 10. A fabric cover 26 is supported by the fabric support ribs 24 in any suitable manner.

The plurality of fabric support ribs 24 are selectably supported in a generally radially outward orientation, hereinafter termed an open orientation, as shown in FIG. 1, by a plurality of rib support elements 30 which are each pivotably mounted onto collar assembly 20 at one end thereof and at an opposite end thereof pivotably mounted onto a corresponding fabric support rib 24.

It is a particular feature of the present invention that the attachment between the rib support elements 30 and the fabric support elements 24 is automatically releasable, as illustrated in FIGS. 2A and 2B, whereby in response to strong winds, detachment occurs, thereby preventing breakage of the fabric support elements 24 or the rib support elements. This automatically releasable attachment is provided, in accordance with a preferred embodiment of the present invention, by a releasable pivotal connection assembly 32, whose structure and function will be described in detail hereinbelow in connection with FIGS. 3A and 3B. The illustrated attachment additionally enhances ease of assembly of the umbrella.

It is appreciated that upon release of the fabric cover 26 and ribs 24 from ribs 30, the ribs 24 and the fabric cover are free to fall by gravity to a closed orientation about shaft 10.

In accordance with a preferred embodiment of the present invention there is also provided an umbrella base assembly 40, suitable for anchoring into soil or sand and preferably including a plurality of concentric recesses each of a different size for accommodating a variety of differently sized umbrella shafts. The umbrella base assembly 40 will be described hereinbelow in greater detail in connection with FIGS. 6 and 7.

Figure 3A:
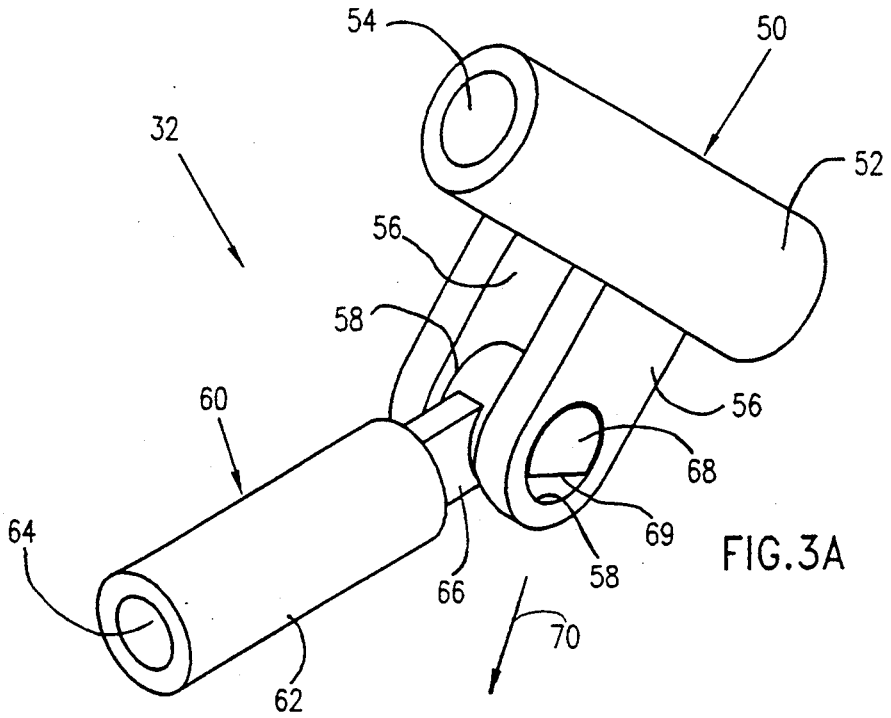
FIGS. 3A and 3B are illustrations of details of a preferred embodiment of the apparatus of FIGS. 2A and 2B respectively in corresponding operative orientations.
Figure 3B:
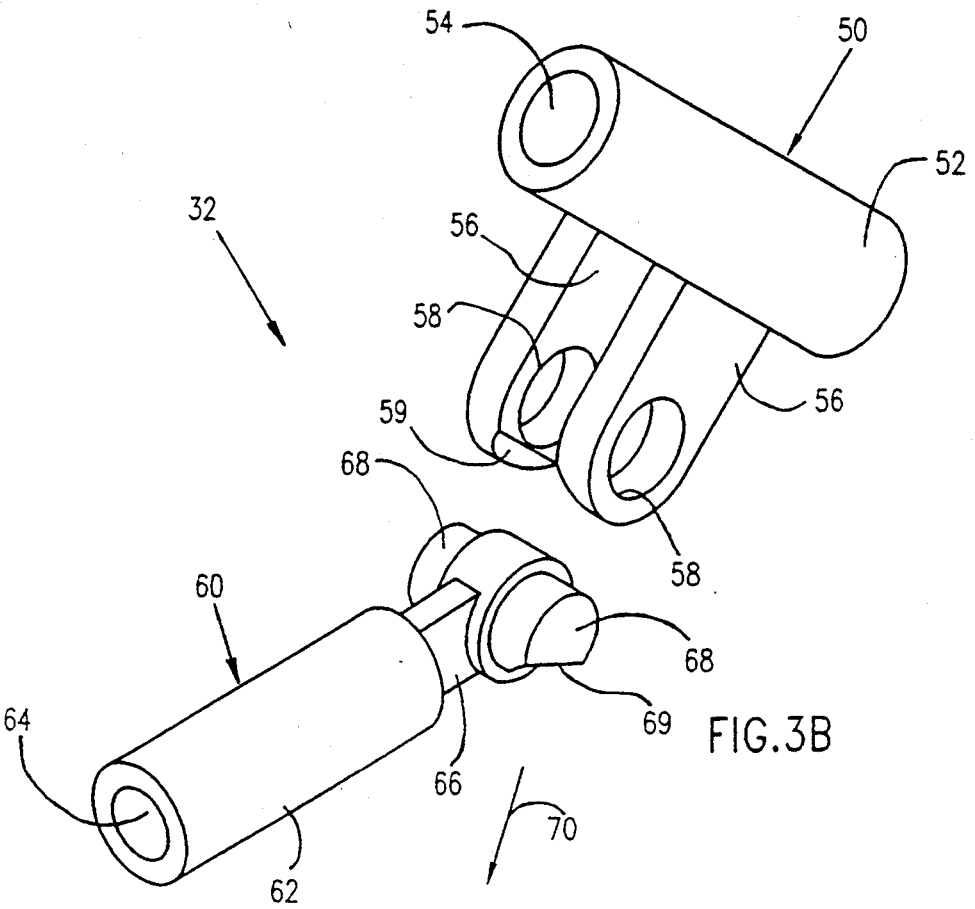

Reference is now made to FIGS. 3A and 3B, which illustrate releasable pivotal connection assembly 32. It is seen that in accordance with a preferred embodiment of the present invention, assembly 32 comprises a fabric support rib mounted element 50, typically including a generally hollow cylindrical portion 52 having a throughgoing bore 54 which receives a fabric support rib 24 and a pair of depending members 56 having a pair of aperture 58 arranged in mutual registration. Preferably the inner bottom surfaces of depending members 56 are tapered as illustrated at reference numeral 59, to ease ingress to apertures 58.

Assembly 32 also comprises a rib support element mounted element 60, typically including a generally hollow cylindrical portion 62 having a bore 64 and terminating in a shaft 66 having a pair of side going protrusions 68 formed thereon. Protrusions 68 are preferably partially tapered as illustrated at reference numeral 69 to ease disengagement of protrusions 68 from the engaged orientation illustrated in FIG. 3A, in response to application of force in a general direction indicated by arrow 70.

Such force, which would be exerted by strong winds, causes the elements 50 and 60 to automatically disengage, as described hereinabove and thus prevent or reduce damage to the umbrella. In the event that the rib support or fabric support is damaged, these elements can easily be replaced in situ.

Reference is no made to FIGS. 4 and 5A–5D, which illustrate the cap assembly 22 and the mounting of the fabric support ribs 24 and fabric cover 26 thereto. The cap assembly 22 comprises a mounting element 80 which is threadably mounted onto an upper end of upper shaft portion 18. Mounting assembly defines a plurality of spaced mounting rod portions 82, which are distributed about the azimuth of the shaft 18, tapered side wall portions 84 and a top ring portion 86.

A fabric cover retaining ring 88 is engaged with shaft 18 over mounting element 86 to tightly retain therebetween the center of the fabric cover 26, which is provided with an aperture 90 to accommodate the threaded portion of shaft 18. A cap element 92 is threadably engaged with shaft 18 so as to retain and cover ring 88.

As seen particularly in FIGS. 5A–5D, fabric support ribs 24 are provided with a hook member 94, which pivotably engages a rod portion 82. The arrangement of the mounting element 80 and of the hook member 94 is such that disengagement of the hook member 94 from rod portion 82 is possible only when the support rib 24 is in a vertical upward orientation and the hook member is displaced radially outward therefrom. At any other relative orientation, as exemplified in FIGS. 5C and 5D, disengagement is not possible. The ability to disengage or engage the hook member 94 permits easy and efficiency assembly and repair.

Figure 6:
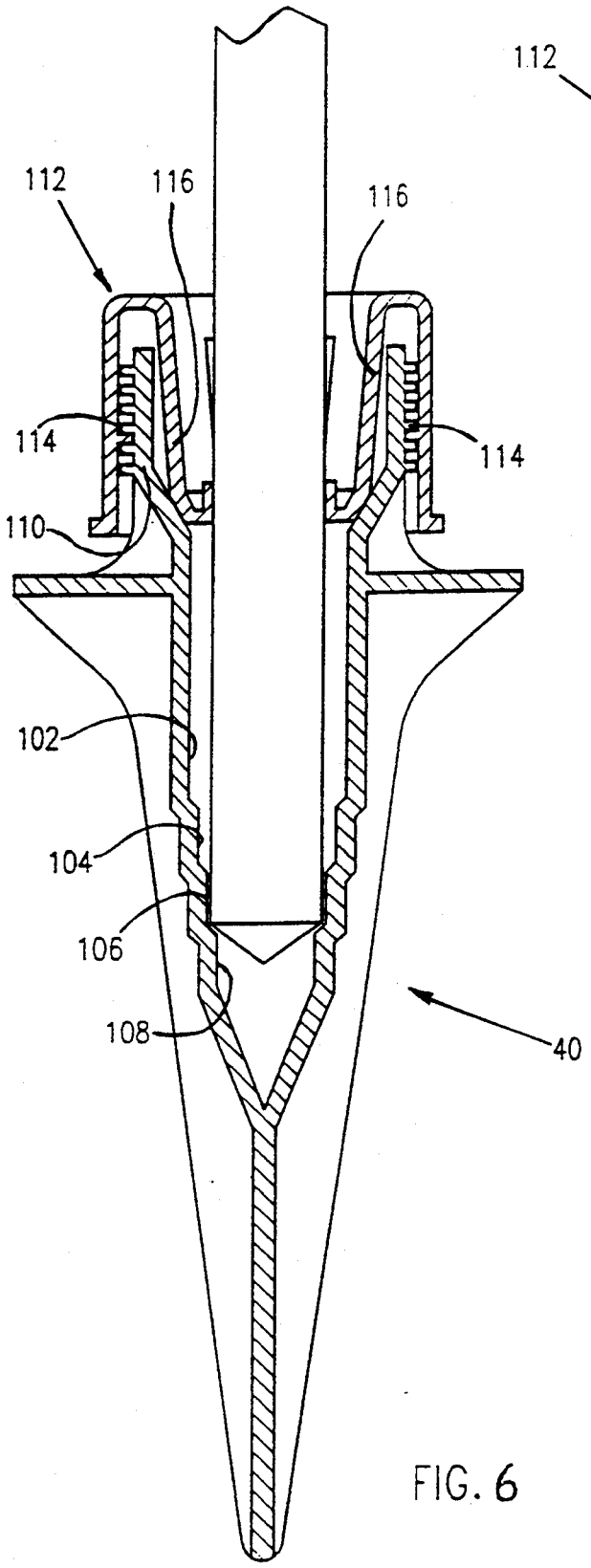
FIG. 6 illustrates a preferred embodiment of an umbrella base having an umbrella mounted therein.
Figure 7:
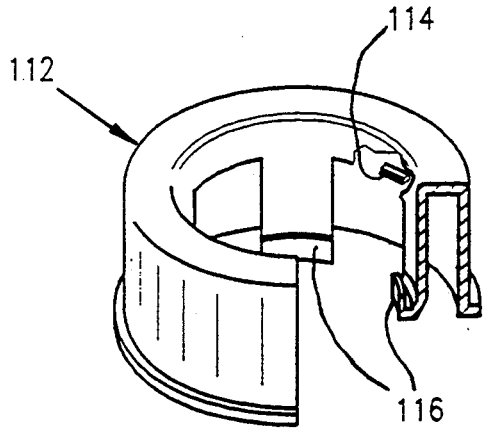
FIG. 7 is a pictorial illustration of a mounting element employed in the arrangement shown in FIG. 6.

Reference is now made to FIGS. 6 and 7, which illustrate a removable mounting base 40 constructed and operative in accordance with a preferred embodiment of the present invention, the mounting base 40 is preferably an injection molded element having an inner recess which has successively narrower recess portions, here shown as recess portions 102, 104, 106 and 108, which are designed to accommodate various diameters of umbrella shafts.

In accordance with a preferred embodiment of the present invention, the base 40 is formed with a threaded top portion 110 which is engaged by a collar member 112 having a selectable inner diameter, corresponding to the outer diameter of the umbrella shaft sought to be retained in base 40.

As seen in FIG. 7, collar member 112 is preferably formed with a plurality of inner protrusions 114 which engage the threading on top portion 110 of the base and defines inner facing finger elements 116 which engage the umbrella shaft and retain it.

Reference is now made to FIGS. 8A–10B, which illustrate tilting mounting assembly 16. Assembly 16 comprises a base member 120 which is secured to shaft portion 14 and includes an upstanding pivot support portion 122. Pivotably mounted to base member 120 for pivotable motion about an axis 123 is a generally cylindrical internal support element 124 having a first portion 126 which is pivotably mounted onto support portion 122, a second generally cylindrical portion 128 onto which is rotatably mounted a cylindrical grip element 130, a third portion 132 which is mounted to the inside of shaft portion 18 and a pair of tap portions, which serve to retain element 124 in engagement with shaft portion 18.

Figure 8B:
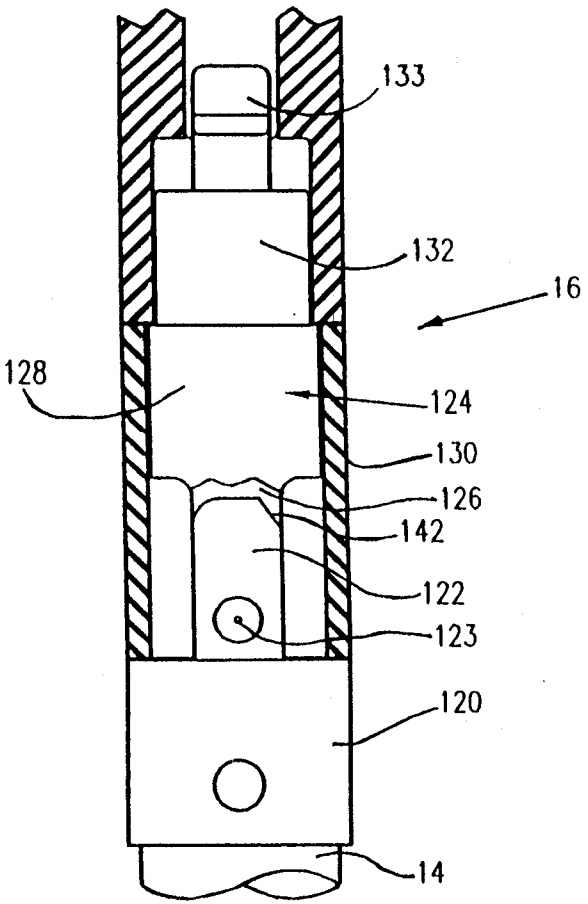
FIGS. 8A and 8B are respective front and front sectional illustrations of tiltable mounting apparatus forming part of the umbrella of FIG. 1 in an upright operative orientation.
Figure 8A:
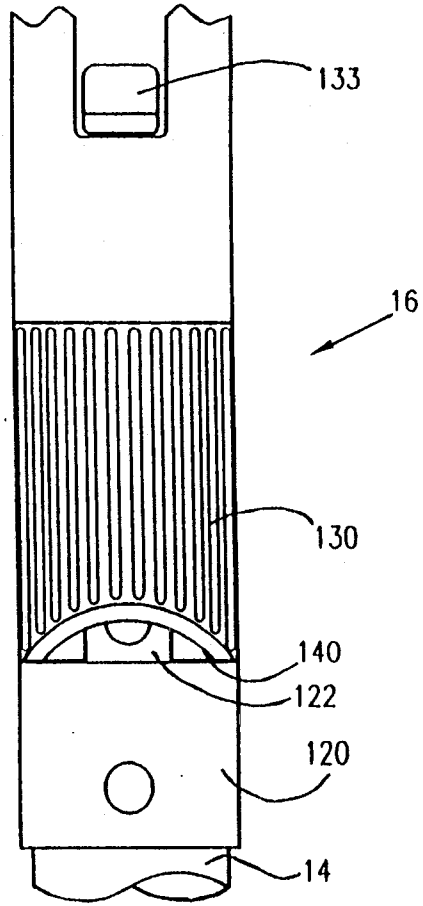
Figure 9B:
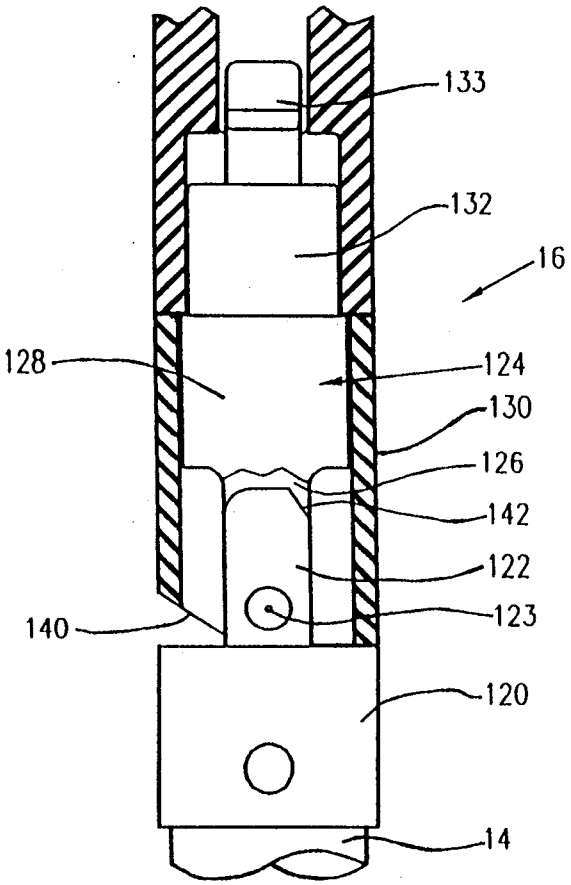
FIGS. 9A and 9B are respective side and side sectional illustrations of tiltable mounting apparatus forming part of the umbrella of FIG. 1 in an upright operative orientation.
Figure 9A:
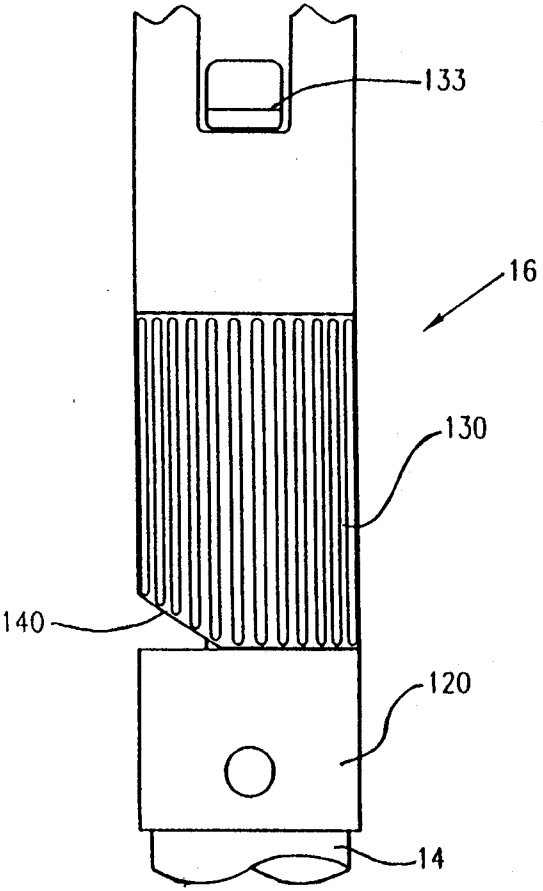

Cylindrical grip portion 130 is formed with an arc shaped cut out along part of the bottom edge thereof. When cylindrical grip portion 130 is rotationally positioned so that the cut out 140 lies along axis 123, as illustrated in FIGS. 8A and 8B, tilting of the umbrella is not possible. If the cylindrical grip portion 130 is rotated by 90 degrees from its position shown in FIGS. 8A and 8B to a position shown in FIGS. 9A and 9B, such that cut out 140 lies alongside axis 123, tilting of the umbrella is possible, as shown in FIGS. 10A and 10B.

Figure 10B:
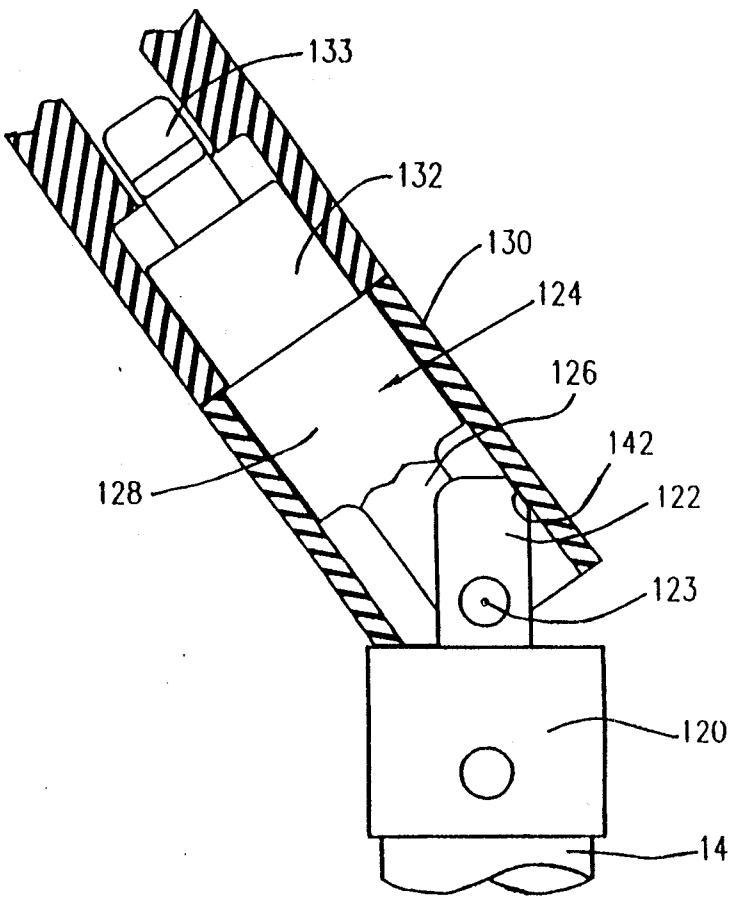
FIGS. 10A and 10B are respective side and side sectional illustrations of tiltable mounting apparatus forming part of the umbrella of FIG. 1 in a tilted operative orientation.
Figure 10A:
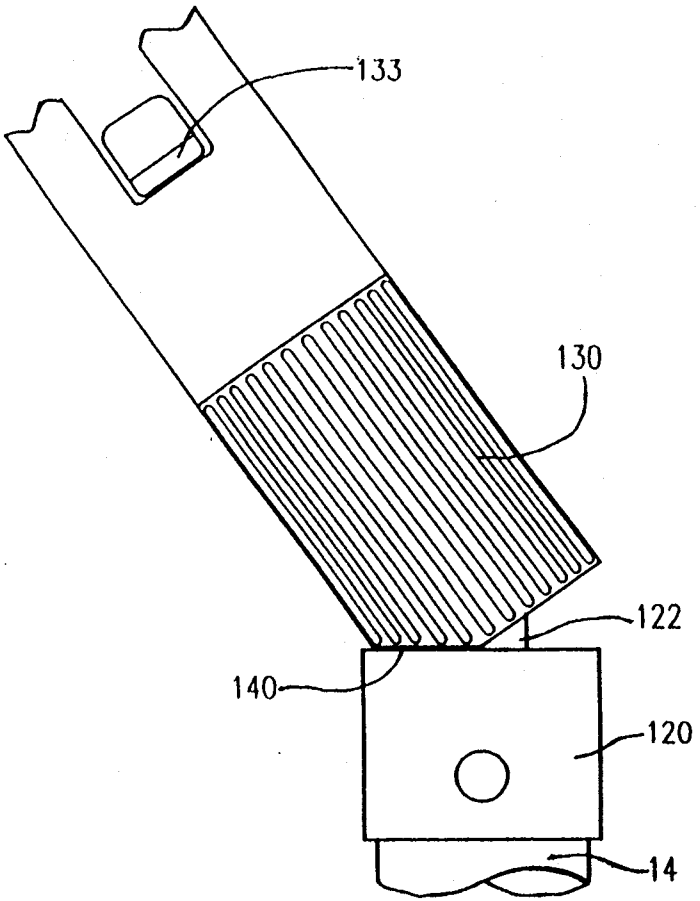

In the tilted orientation shown in FIGS. 10A and 10B, the edge of cut out 140 rests on a portion of the top surface of base member 120 and an inclined edge 142 of portion 122 supports a corresponding surface portion of the interior of cylindrical grip portion 130.

It will be appreciated by persons skilled in the art that the present invention is not limited by what has been particularly shown and described hereinabove. Rather the scope of the present invention is defined only by the claims which follow:

We claim:

1. An umbrella comprising:

a central shaft;

a plurality of fabric support ribs extending outwardly from the central shaft;

a fabric cover associated with the fabric support ribs;

a plurality of rib support elements for supporting the fabric support ribs; and a plurality of detachable attachment elements, each operative to detachably attach a rib support element onto a fabric support rib, whereby in response to strong winds, detachment occurs, thereby preventing breakage of the support ribs, and wherein said a central shaft includes upper and lower portions and said umbrella also comprises a tiltable mounting assembly connecting the upper and lower portions of the central shaft, and wherein the upper shaft portion defines a first longitudinal axis and includes a recess opening at a bottom end thereof and defines a bottom end surface at the recess including a first surface portion extending perpendicular to the first longitudinal axis and a second surface portion angled with respect to the first surface portion, the lower shaft portion defines a second longitudinal axis, and wherein the tiltable mounting assembly includes:

a support element mounted on the lower shaft portion and defining a support surface extending perpendicular to the second longitudinal axis and having an upstanding portion extending into the recess on the upper portion, the upstanding portion including an angled bearing surface; and an anchor element mounted inside the recess of the supper shaft portion and pivotably mounted onto the upstanding element, the upper shaft member being tiltable with respect to the upstanding element such that the second surface portion rests on the support surface and the angled bearing surface lies against an inner side surface of the recess.

2. An umbrella according to claim 1 and also comprising an umbrella base supporting said shaft including a plurality of concentric recesses each of a different size for accommodating a variety of differently sized umbrella shafts.

3. An umbrella comprising:

a central shaft having upper and lower portions;

a fabric cover supported on the central shaft; and a tiltable mounting assembly connecting the upper and lower portions of the central shaft, and wherein the upper shaft portion defines a first longitudinal axis and includes a recess opening at a bottom end thereof and defines a bottom end surface at the recess including a first surface portion extending perpendicular to the first longitudinal axis and a second surface portion angled with respect to the first surface portion, the lower shaft portion defines a second longitudinal axis, and wherein the tiltable mounting assembly includes:

a support element mounted on the lower shaft portion and defining a support surface extending perpendicular to the second longitudinal axis and having an upstanding portion extending into the recess on the upper portion, the upstanding portion including an angled bearing surface; and an anchor element mounted inside the recess of the supper shaft portion and pivotably mounted onto the upstanding element, the upper shaft member being tiltable with respect to the upstanding element such that the second surface portion rests on the support surface and the angled bearing surface lies against an inner side surface of the recess.

* * * * *